United States Patent [19]

McCabe

[11] 4,195,384

[45] Apr. 1, 1980

[54] SELF-RESETTING, CABLE OPERATED TRANSLATING DRIVE LINK

[76] Inventor: Francis J. McCabe, 239 Hasting Ct., Doylestown, Pa. 18901

[21] Appl. No.: 896,299

[22] Filed: Apr. 14, 1978

Related U.S. Application Data

[63] Continuation-in-part of Ser. No. 779,044, Mar. 18, 1977, Pat. No. 4,099,292, which is a continuation-in-part of Ser. No. 676,483, Apr. 13, 1976, Pat. No. 4,041,570, which is a continuation-in-part of Ser. No. 676,413, Apr. 13, 1976, Pat. No. 4,040,304, which is a continuation-in-part of Ser. No. 764,774, Feb. 2, 1977, which is a continuation of Ser. No. 689,994, May 26, 1976, Pat. No. 4,081,173, which is a continuation-in-part of Ser. No. 896,237, Apr. 14, 1978.

[51] Int. Cl.[2] ..... E05F 15/20

[52] U.S. Cl. ..... 16/48.5; 49/2; 160/9

[58] Field of Search ..... 16/48.5, 49; 49/1, 2, 49/5, 8; 160/1, 2, 8, 9

[56] References Cited

U.S. PATENT DOCUMENTS

| | | | |
|---|---|---|---|
| 980,443 | 1/1911 | Shuman | 160/1 |
| 3,725,972 | 4/1973 | McCabe | 16/48.5 |
| 3,889,314 | 6/1975 | McCabe | 16/48.5 |
| 4,074,388 | 2/1978 | McCabe | 16/48.5 |
| 4,099,292 | 7/1978 | McCabe | 16/48.5 |

*Primary Examiner*—George H. Krizmanich
*Attorney, Agent, or Firm*—Benasutti Associates, Ltd.

[57] ABSTRACT

A novel telescoping heat responsive releasing device is described wherein a mounting member on which heat responsive and locking means are mounted slidingly enages a pawl member which is movable between a first position in which the pawl member is capable of being restrained by the aforementioned latching means, and an activated position wherein associated apparatus connected to said releasing device may assume the desired heat responsive posture. In the preferred embodiment, a biasing means is provided for biasing said mounting member and said pawl member from said activated position towards said first or normal position. Various alternate embodiments are illustrated showing various attachment sliding and mounting configurations.

30 Claims, 8 Drawing Figures

SELF-RESETTING, CABLE OPERATED TRANSLATING DRIVE LINK

CROSS-REFERENCE TO RELATED APPLICATIONS

The present application is a continuation-in-part of my prior co-pending patent application Ser. No. 779,044, filed Mar. 18, 1977 entitled, "Telescoping Heat Responsive Releasing Means", now U.S. Pat. No. 4,099,292, dated July 11, 1978, which in turn is a continuation-in-part of my prior co-pending patent application entitled, "An Electrical Pneumatic Heat Actuated Fire Link Apparatus", Ser. No. 676,483, filed Apr. 13, 1976, now U.S. Pat. No. 4,041,570, dated Aug. 16, 1977, as well as a continuation-in-part of my prior co-pending patent application entitled, "Clutch Motor For Use In Resettable Fire Damper", Ser. No. 676,413, filed Apr. 13, 1976, now U.S. Pat. No. 4,040,304, dated Aug. 9, 1977, which applications are incorporated herein by reference as if fully set forth herein.

The present application is also a continuation-in-part of my prior co-pending patent application Ser. No. 764,774, filed Feb. 2, 1977 entitled, "Rotating Blade Fire Damper", which in turn is a continuation of application Ser. No. 689,994, filed May 26, 1976 entitled, "Rotating Blade Fire Damper", now U.S. Pat. No. 4,081,173, dated Mar. 28, 1978, which applications are also incorporated by reference as if fully set forth herein.

The present application is also a continuation-in-part of my prior co-pending patent application entitled, "Electro-Thermal Fire Protection Locking Clip", Ser. No. 896,237, filed Apr. 14, 1978, which application is also specifically incorporated herein by reference.

BACKGROUND OF THE INVENTION

The present invention generally relates to the field of releasing devices, and more particularly, releasing devices employing bimetals or other heat responsive means, which releasing devices are conventionally used to actuate various fire protection equipment in response to increase in heat in the vicinity of the device.

Conventionally, fuseable or meltable releasing devices have been employed, such as fuseable links in cables which are held under tension in normal conditions and which are actuated by the melting of the link and the resulting break of the cable.

More recently, bimetallic links, such as those illustrated in my previously issued U.S. Pat. Nos. 3,889,314 entitled, "Heat Actuated Link", and 3,725,972 entitled, "Fire Link and Method of Actuating Same" have been described wherein a mounting element having a bimetallic strip attached thereto, which cooperates therewith, may engage a pawl having an aperture therein which is engaged by the bimetallic element in the normal position, and which is released thereby as the tip of the bimetallic element separates from the mounting or striker portion thereof to release the pawl. These bimetallic links have conventionally been installed by attaching a cable to either the pawl, the mounting element, or both in a manner similar to that use for the fuseable or meltable links described above. These bimetallic links have exhibited certain advantages over the prior art fuseable links in that following a return to normal temperatures, the link may be reset simply by re-inserting the pawl into the remaining link assembly.

Unfortunately, prior art devices of the type described above have required that acess be provided to the link device so that manual resetting is possible. In certain installations, such as smoke tunnels, ducts, plenums, etc., human access to reset or replace releasing devices is limited. Additionally, relatively skilled personnel must be employed in order to reset or replace the aforementioned releasing devices. In the case of the bimetallic links, these people must at least understand the proper method of inserting the pawl so that is properly gripped by the remaining portion of the link.

For one approach to this problem, please refer to my previously issued U.S. Pat. No. 3,796,248, dated Mar. 12, 1974 entitled, "Remotely Resettable Fire Damper".

SUMMARY OF THE INVENTION

The present invention is basically an improvement over the device illustrated in by prior co-pending patent application Ser. No. 779,044, filed Mar. 18, 1977 entitled, "Telescoping Heat Responsive Releasing Means", which in turn is an improvement over the device as illustrated in my previously issued U. S. Pat. No. 3,889,314 entitled, "Heat Actuated Link"; U. S. Pat. No. 3,725,972 entitled, "Fire Link and Method of Actuating Same"; and U.S. Pat. No. 3,796,248 entitled, "Remotely Resettable Fire Damper".

Basically, the present invention comprises a telescopingtype heat responsive releasing device wherein two members are provided which slide with respect to each other between normal and actuated positions, said device being provided with biasing means for biasing those members generally towards the normal position to automatically reset the device in response to the return of pre-fire conditions. A heat responsive means, such as a bimetallic element is mounted on one of said members to respond at least to the ambient temperature therearound, which heat responsive means is adapted to cause a latching means to restrain said members relative to each other in the normal or restrained position under normal temperatures, and to release the members in response to at least a predetermined increase in ambient temperature, whereby the forces exerted by the remainder of the fire protection apparatus deployed therewith may cause the members to slide into their relative activated position. These forces also act to load the biasing means so that relief of the forces applied by the apparatus deployed therewith will cause the releasing device to automatically re-assume the normal position. In the event that ambient temperatures surrounding the bimetallic element have also returned to normal, the releasing device will reset, thereby locking the members in the normal position to thereby fully reset the device. Since sliding engagement between the two members is maintained at all times, the setting of the device may be accomplished from a remote location once normal temperatures are restored, since the sliding of the two members back into the normal position is accomplished by the biasing means, whereupon the latching means will automatically receive and again restain the members relative to each other.

By way of example, the preferred embodiment of the present invention is adapted for use in such installations as fire dampers or doors which are weighted or sprung to move to their closed position, but which are normally restrained by a cable having a releasing link disposed therealong. In response to excessive heat or a remote signal, the preferred embodiment of the present invention which is attached as the "link" within the cable, will be activated, thus allowing the two moveable members of the releasing device to be extended or telescoped by the forces applied by the springs or weights of the closure mechanism to move the door or damper into its closed position. Even if the door or damper is reopened in the presence of excessive heat or while a remote activating signal is maintained to the heat responsive means the releasing device will not fully reset. Although the slack produced in the cable will be taken up as the biasing means causes the moveable members to slide to the normal position, the heat responsive means will maintain the latching means in its released position. Once normal temperature (or signal) conditions are re-established, however, the latching means will be moved to its normal (resettable) position and the device will automatically reset merely by reopening the fire damper or door or otherwise relieving tension on the cable along which the releasing device is mounted. At this time the latching means will have assumed a position to re-engage and restrain the two slideable members with respect to each other in the normal position, which normal position will have been automatically re-established through the action of the biasing means.

The present invention also provides a number of novel mounting and pawl means configurations which also include a variety of mountings for the particular heat responsive means and/or biasing means utilized with the particular releasing device of each embodiment. In the preferred embodiments, a negator-type spring is utilized as the biasing means.

In one alternate embodiment, a bimetallic element and the body of the negator spring are both mounted on opposing sides at one end of a somewhat elongated mounting member which slides within a channel formed by two spaced apart plates which comprise the pawl means of that embodiment.

In a second alternate embodiment, the mounting means comprises two spaced apart mounting members which define a channel therebetween within which a pawl member is disposed in sliding engagement within the channel. The body of the negator spring is mounted at a remote end of the releasing device on the same side of the device as the heat responsive device.

In a third alternate embodiment, the heat response means is a thermo-electric cylinder, the cylinder rod of which is filled with a key lock latching means which cooperates in a "T"-shaped slot in the pawl member to restrain with the pawl member relative to the mounting member under normal conditions.

In a fourth alternate embodiment, a thermo-electric cylinder is utilized as a heat responsive means to withdraw a pin from an aperture in the pawl means to thereby activate the releasing device. In this embodiment, the force applied by the thermo-electric cylinder is amplified by a lever mechanism which biases the pin into its normal (locking) position.

Accordingly, the primary object of the present invention is the provision of a telescoping heat responsive releasing device which will automatically reset once normal temperatures (and normal signal conditions) are restored, and the tension applied to the releasing device by the remainder of the fire protection apparatus with which it is deployed is reduced, to thereby allow the various sliding members to automatically recycle to their normal (restrained) position.

Another object of the present invention is the provision of an inexpensive, fail-safe heat responsive releasing device which is remotely resettable.

A further object of the present invention is the provision of a heat responsive releasing device with the above-described features which is additionally mechanically or electrically activatable from remote locations while at all times retaining the ability to respond to local conditions of excessive heat.

A further object of the present invention is the provision of a heat responsive releasing device utilizing a thermo-electric cylinder to release the same.

A further aim of the present invention is the provision of a heat responsive releasing device wherein amplification means are provided for amplifying the force of a heat responsive means to activate the releasing device.

These and other objects of the present invention will become apparent from the following more detailed description.

DESCRIPTION OF THE PREFERRED EMBODIMENTS

Figure 1:
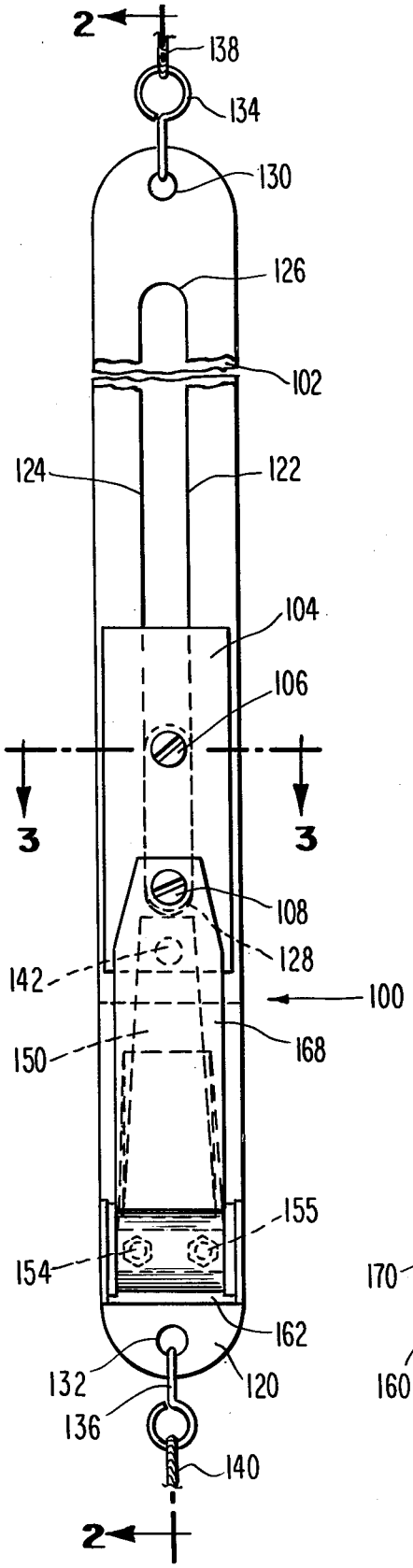
FIG. 1 is a foreshortened top view of a first alternate embodiment of releasing device of the present invention shown in its normal position.

Although specific forms of the invention have been selected for illustration in the drawings, and the following description is drawn in specific terms for the purpose of describing these forms of the invention, this description is not intended to limit the scope of the invention which is defined in the appended claims.

Figure 2:
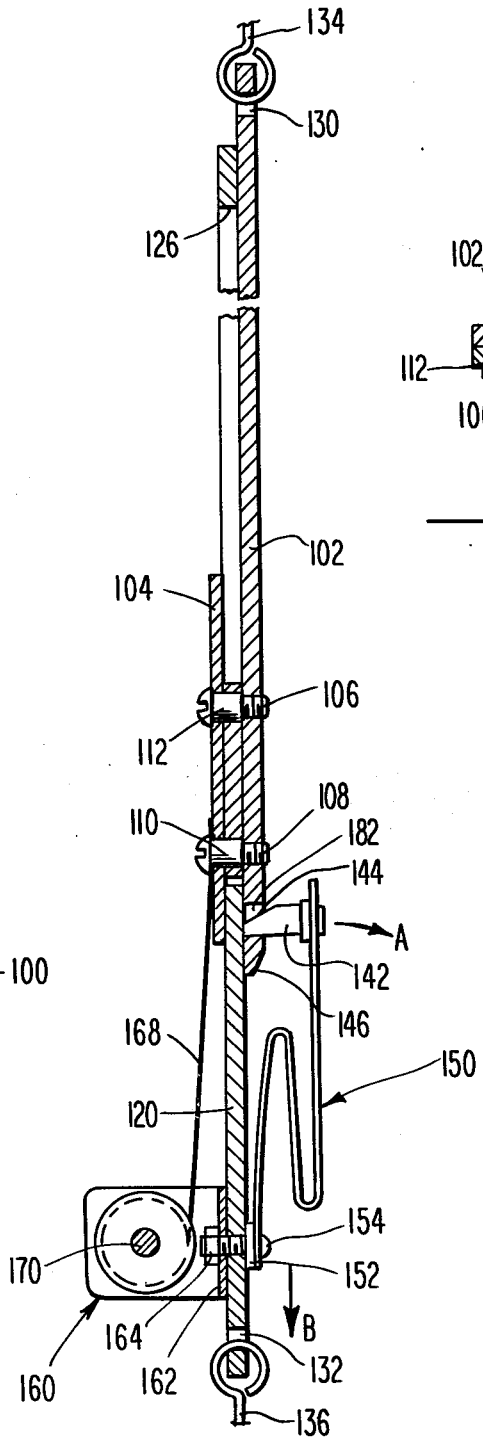
FIG. 2 is a foreshortened cross-section of the device illustrated in FIG. 1, taken as indicated by the lines and arrows 2—2 in FIG. 1.
Figure 3:
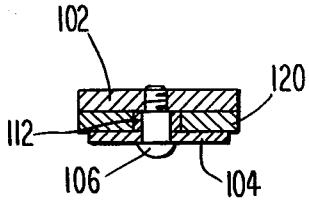
FIG. 3 is a cross-section of the device illustrated in FIG. 1, taken as indicated by the lines and arrows 3—3 in FIG. 1.

Referring to the drawings, and particularly FIGS. 1–3 thereof, a first alternate embodiment releasing device of the present invention is illustrated. As with each of the preferred embodiments described hereinafter, the telescoping heat responsive releasing device of the present invention generally comprises at least one mounting member, a pawl means slidably engaging the mounting member for reciprocal movement therealong, a latching means for selectively restraining said pawl means relative to said mounting member, and for selectively releasing said pawl member with respect to said mounting member, heat responsive means mounted on said mounting member for causing said latching means to selectively restrain or release said pawl member at least in response to said preselected normal ambient temperature conditions and preselected increases in said ambient temperature conditions, stop means for preventing said members from sliding relatively beyond said normal or activated positions, tracking means for defining the path of sliding movement between said positions, and biasing means for biasing said pawl member and said mounting member generally into a normal position wherein said members may be restrained by said latching means. Accordingly, in each of the preferred embodiments described hereinafter, at least a portion of the mounting member comprises a bearing surface which is complementally configured to an opposing bearing surface on that portion of the pawl member slidingly engaged by said mounting member. In each of the embodiments described hereinafter, either two spaced apart mounting members or two spaced apart pawl members are provided which are spaced apart by spacing means for establishing a channel therebetween within which the complemental member track. In order to establish the tracking path, in the embodiments illustrated in the tacking means comprises a slot in the intermediate member having at least one bearing member mounted therein to guide the pawl and mounting members during the sliding thereof between the normal and activated positions. In each preferred embodiment, the device will not reset, that is, the ability of the mounting and pawl members to slide relative to each other will not be interfered with by the latching means as long as increased temperatures or other activation signals continue to be received by the heat responsive means. Once normal ambient temperature or signal conditions are restored, however, and the tension externally applied to the releasing device is lessened to the point where it is overcome by the biasing means, the pawl and mounting members will recycle with respect to each other at least through the restrained (normal) position, whereupon means which comprise the latching means will insure the automatic resetting of the device to re-establish the relatively fixed relationship between the members, pending the next activation thereof. In each of the illustrated embodiments, the stop means is configured to ensure that over-travel of the mounting and pawl members beyond either the normal position or the activated position, or both, is prevented by interference between parts associated with said members.

In FIGS. 1, 2 and 3, a first preferred embodiment releasing device, designated generally 100 is illustrated wherein the pawl means comprises two spaced apart pawl bars 102 and 104, which spacing is maintained by spacing means comprising a plurality of screws 106 and 108 which are fitted by spacing bushings 110 and 112. In this embodiment the spacing, tracking, and stop means comprises the spacing bushings which space the opposing surfaces of pawl bars 102 and 104 apart by a distance which is substantially equal, to or slightly greater than the thickness of mounting bar 120. In addition spacing bushings 110 and 112 act as guide means disposed within a substantially elongate slot defined in mounting bar 120 by longitudinal edges 122 and 124 which are joined by rounded terminuses 126 and 128, which cooperate with the spacing bushings 110 and 112 to limit the travel of the mounting means with respect to the pawl means. As shown in the figures, cable attachment sites 130 and 132 which are apertures defined in the remote ends of the pawl bar and mounting bar respectively facilitate the attachment of cable fasteners 134 and 136 to either end of the releasing device to thereby conveniently receive cables 138 and 140 which, in most common installations, are commonly under tension.

The foreshortening in FIG. 1 of the pawl and mounting bars 102 and 120 highlights the fact that the length of travel of the pawl and mounting means relative to each other between the normal and activated positions may be selected to fit the activation requirements of associated fire protection apparatus. The actual length of travel of the pawl and mounting means with respect to each other between the normal and activated positions will, of course, be established by the length of the slot defined in the pawl bar 102 less the distance of separation between the surfaces of the spacing bushings 110 and 112 which contact either end of that slot in these positions.

As illustrated in FIG. 1–3, the latch means of this embodiment comprises a pin 142 having a bevelled surface 144 thereon which is adapted to ride up over a complementally formed bevel 146 in the end of the pawl bar 102 which is engaged by the bevelled surface 144 of the pin 142 as the pawl bars are moved relatively together with the mounting bar into the normal position, as shown in the figures.

As the normal (locked) position is reached, the pin 142 snaps into latching aperture 182 defined in the pawl bar 102. In this embodiment, the heat responsive means comprises a serpentine bimetallic element 150 which has mounted on the tip thereof the aforementioned pin 142, and in turn is mounted at its base adjacent to the remote end of mounting bar 120 through spacer 152 by bolt 154. While a bimetallic element similar to that disclosed in my prior U.S. Pat. No. 3,725,972 entitled, "Fire Link and Method of Actuating Same", is illustrated in this embodiment, it is within the scope of the present invention to substitute a bimetallic element similar to that illustrated in my prior U. S. Pat. No. 3,889,314 entitled, "Heat Actuated Link" as the heat responsive means in this embodiment, as well as in the hereinafter described embodiments illustrating other aspects of the present invention. The biasing means of this embodiment of the present invention is preferably a negator-type of spring, designated generally 160. The biasing means 160 has upright sidewalls 161, 161 connected to a base 162 which is bolted by nut 154 and bolt 164 to the remote end of the mounting bar 120 at a point which generally opposes the point of attachment of the heat responsive means on that bar. As is standard for negator springs of this type, the leaf 168 of the negator spring is coiled around a central shaft 170 of that spring mounted between the sidewalls 161, 161. The negator spring tends to resist the extension of the tongue of that spring away from the coil, and tends to draw the tip or tongue of that spring towards the coil at all times. As shown in FIGS. 1 and 2, the tip of the spring 168 is bolted by machine screw 108 to the exterior surface of pawl bar 104. Since the device is in its normal position, further withdraw of the tip of the spring towards the coil is resisted by the interference between spacing bushing 110 and the curved terminus 128 of the slot.

The embodiments of FIGS. 1–3 operates as follows. In its normal position as illustrated in the figures, substantial tensions can be applied through cables 138 and 140. The tension applied by these cables which otherwise would tend to separate the mounting and pawl means are resisted to some extent by the biasing means 160, however, primarily by the restraint produced by the disposition of the tip of pin 142 in latch aperture 182, which is disposed near the "proximate" end of pawl bar 102. As shown in the figures, and particularly in FIG. 2, the serpentine bimetallic element has assumed the position shown in response to a normal ambient temperature. In the event that substantial increase in the ambient temperature should occur, or alternatively, in the event that the bimetallic element is heated by some external means, such as a remote-signal, activating apparatus to heat the element, the element will cause the pin 142 to withdraw from the latching aperature 182 in the direction of arrow A shown in FIG. 2. Upon withdraw of the spring, the activation tension applied by the cables (which in every event is selected to be greater than the tension applied by the negator spring 168) will overcome the tendency of that negator spring to draw the mounting and pawl means together, and, assuming for purposes of illustration that the pawl means is relatively fixed, will cause the mounting means to separate therefrom in the direction of arrow B in FIG. 2 until that separation is caused to cease by reason of the interference of spacing bushing 112 with terminus 126 of the slot defined in the mounting bar 102. Whenever the tension applied by cables 138 and 140 slacken to attention less than the forces applied by negator spring 160, the pawl and mounting means will tend to slide relatively towards their actuated position, which movement will tend to take up any slack in the cable. The device will not, however, fully reset until normal ambient temperature or signal condition are re-established, whereupon the bimetallic element 150 will cause the pin 142 to reassume the position shown particularly in FIG. 2 where the tip thereof contacts a surface of the mounting bar 120. If, upon re-establishment of the normal ambient temperature or signal conditions, the pawl bars are in the position shown in FIGS. 1–3, the pin will merely re-enter aperture 182 in the bars to relock the pawl and mounting means in this normal position. If, however, the pawl and mounting means have not returned from the activated position when normal ambient temperature or signal conditions are re-established, upon the return of those means to the normal position, the bevelled surface 144 of the pin 142 and bevelled surface 146 of pawl bar 102 will coact with each other to overcome the biasing of the pin 142 towards the surface of the mounting bar 120 to cause that pin to ride up and over the tip portion 102 to snap into latching aperture 182 to re-establish the relative locking of the pawl and mounting means in that position.

Figure 4:
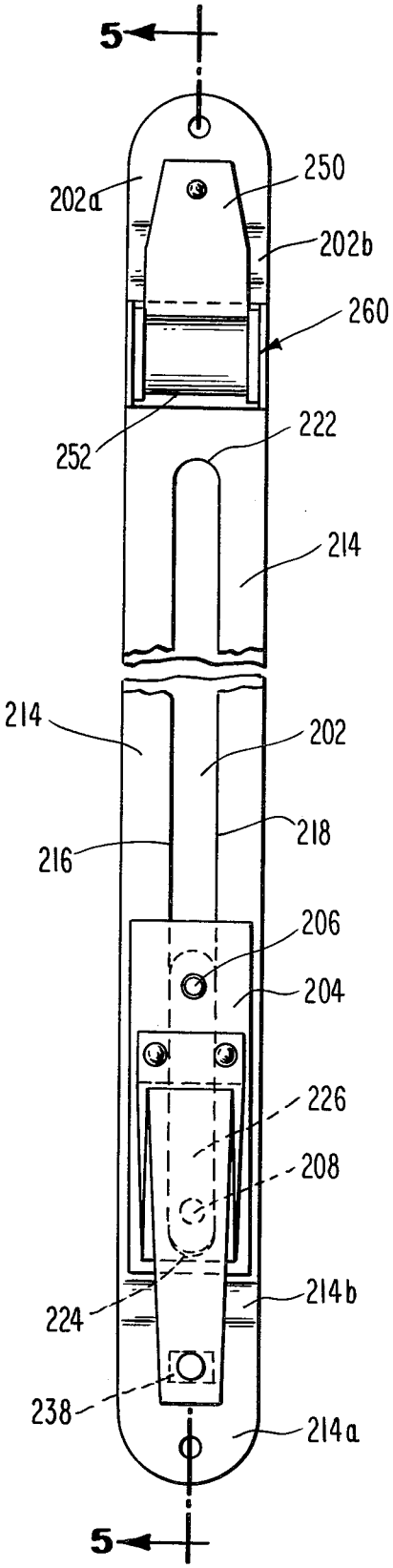
FIG. 4 is a foreshortened top view of a second alternate embodiment releasing device of the present invention shown in its normal position.
Figure 5:
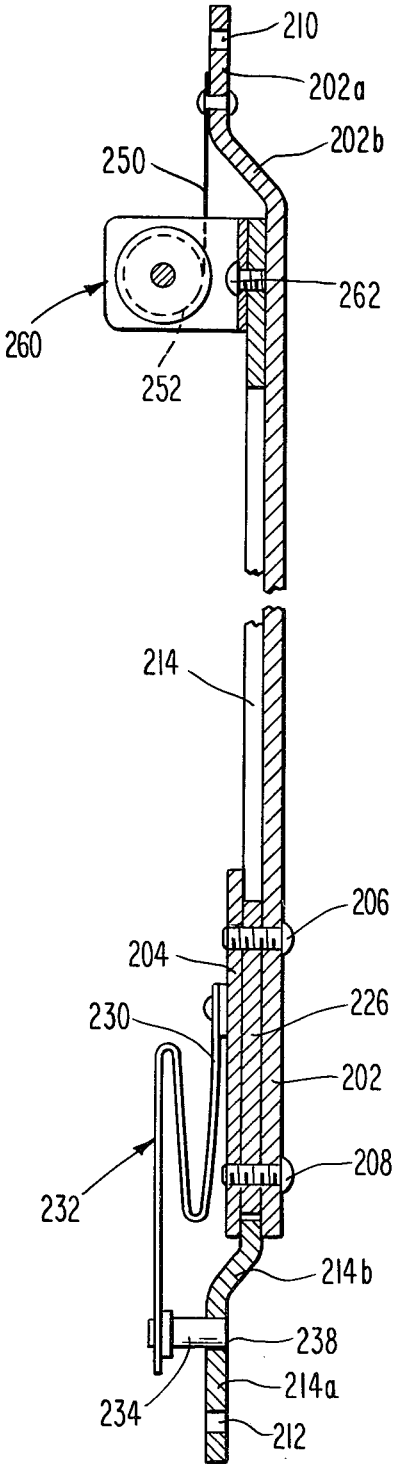
FIG. 5 is a foreshortened cross-section of the device as shown in FIG. 4, taken as indicated by the lines and arrows 5—5 in FIG. 4.

Referring now in particular to FIGS. 4 and 5, a second alternate embodiment releasing device in accordance with the present invention is illustrated. In the embodiment of FIGS. 4 and 5, the mounting means is differentiated into mounting bars 202 and 204 which are spaced apart by spacing member 226 which is held in position by machine screws 206 and 208. The remote end of mounting bar 202 is configured to form an offset portion **202*a*, which is connected to the main body of the bar by a diagonal (transverse) portion 202*b*. Cable attachment sites 210 and 212 are provided on mounting and pawl bars 202 and 214, respectively. In this embodiment, the pawl bar 214 has a longitudinally extending slot defined therein by longitudinal edges 216 and 218 which terminate in rounded termini 220 and 222. Unlike the previous embodiment, however, wherein spacing bushings were associated with each of the screws spacing apart the members defining a channel therebetween, in this embodiment, a single tracking, spacing and stop member 226 is slideable disposed within the slot formed in the pawl member 214. This spacing member 226 accordingly acts as a spacing means for spacing the mounting bars 202 and 204 apart by a distance sufficient to enable the pawl bar 214 to freely slide therebetween. This spacing member (together with the slot) additionally acts as a tracking means for establishing the path of movement of the pawl bar 214 with respect to the mounting bars 202 and 204, while finally acting (together with the slot) as a stop means for limiting the length of travel of the mounting bars with respect to the pawl bar by reason of the interference which is created between the ends of the spacing member 226 and the termini 222 and 224 of the slot defined within the pawl bar 214**.

The pawl bar 214 is differentiated at its remote end into an offset portion **214*a* which is connected to the main body of the bar by a transverse or diagonal portion 214*b*. In addition to coaxially aligning the cable attachment sites 210 and 212, these offsets provide additional advantages to the embodiment of FIGS. 4 and 5. The diagonal or transverse portion 214*b* of the pawl bar provides an exterior surface which obviates the necessity of bevelling either a portion of a pawl bar or a portion of the pin 234 of the latching means of this device. Accordingly, during the resetting of the device, the pin 234 will naturally slide over and be displaced by the exterior surface of the diagonal or transverse portion 214*b* until it is oriented over the locking aperture 238 defined in the offset portion 214*a* of the pawl bar. Similarly, in this embodiment, the offset portion 202*a* of the mounting bar 202 facilitates the attachment of the tip 250 of negator spring 260 thereto such that the negator spring will apply its forces along an axis which is almost exactly parallel to the axis of travel of the pawl and mounting members with respect to each other. Thus, any slight tendency of the pawl and mounting members to beind with respect to each other during the movement thereof caused by the negator spring will be substantially eliminated by reason of this mounting configuration. Additionally, in this embodiment the negator spring 260 which is mounted to the "proximate" end of pawl bar 226 is located generally on the same side of the pawl and mounting bars as the bimetallic element 232, which is mounted to an exterior surface of mounting bar 204**.

Figure 6:
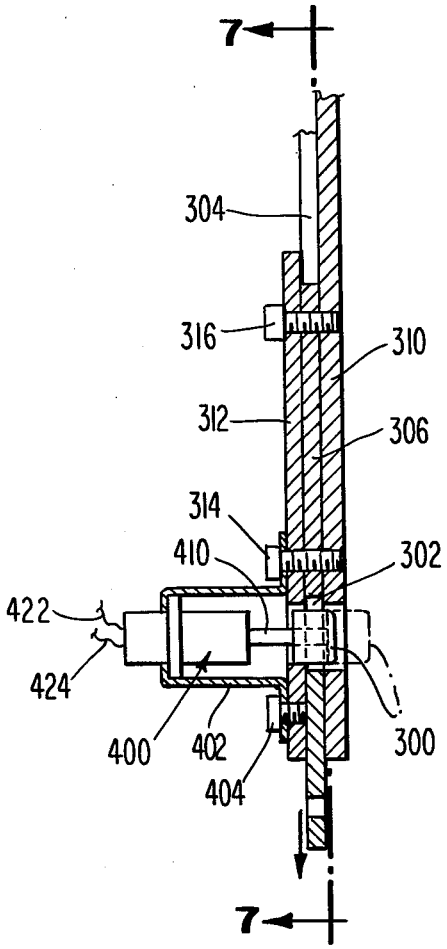
FIG. 6 is a fragmentary cross-section of a third alternate embodiment releasing device of the present invention shown in its normal position.
Figure 7:
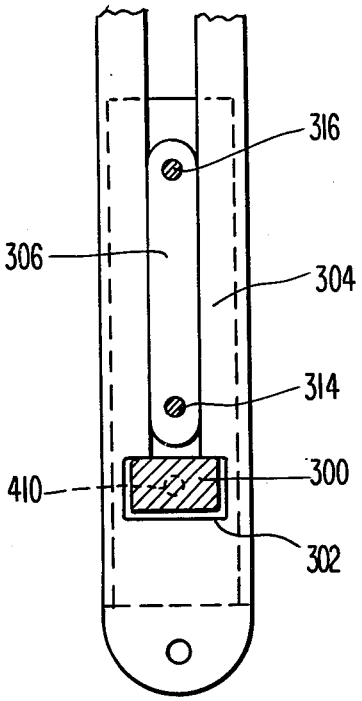
FIG. 7 is a fragmentary cross-section of a portion of the device shown in FIG. 6, taken as indicated by the lines and arrows 7—7 in FIG. 6.

Referring now to the embodiment of FIGS. 6 and 7, a releasing device is illustrated in accordance with a third alternate embodiment of the present invention. In the embodiment of FIGS. 6 and 7, novel heat responsive and latching means are illustrated for use in combination with a releasing devise otherwise in accordance with the present invention. In this embodiment, the latching means comprises a latching block 300 which is sized to enter an enlarged terminal portion 302 of a key slot defined in the pawl member 304. As with the embodiment illustrated in FIGS. 4 and 5, the mounting member of this embodiment is differentiated into mounting bars 310 and 312 which are spaced apart from each other by spacing member 306 which is held therebetween by two machine screws 314 and 316. The spacing member 306 is slideably disposed within the narrow elongated portion of the key slot defined the pawl bar 304 to act in a similar manner to that described hereinabove with reference to the embodiment of FIGS. 4 and 5. Unlike the slot defined in the pawl member of the embodiment of FIGS. 4 and 5, however, in the embodiment of FIGS. 6 and 7, the remote terminus of the slot defined in pawl bar 304 is an enlarged, rectangular portion 302 of the slot which receives latching block 300 which not only locks the movement of the pawl bar 304 with respect to the mounting bars 310 and 312 in this position, but also defines the "normal position" end of travel of the pawl bar 304 with respect to mounting bars 310 and 312. In this embodiment, the heat responsing means comprises a thermo-electric cylinder or other cylinder means which is adapted to move the latching block 300 between locking and unlocking positions where block 300 no longer interferes with the edges of the enlarged key slot portion 302 of the pawl bar 304, such that the pawl bar and mounting bars are free to slide with respect to each other into the activated position. The thermoelectric cylinder, designated generally 400 is accordingly mounted by a mounting bracket 402 to an appropriate external surface of mounting bar 312 by the aforementioned machine screw 34 on one side and cylinder bracket mounting screw 404 on the other. The thermo-electric cylinder of the preferred embodiment shown in FIGS. 6 and 7 will cause the unlocking of the device by extending the block 300 into the position shown in phantom in FIG. 6, whereupon the cylinder rod 410, which has a substantially smaller diameter than the width of the slot defined in the pawl bar, will be free to ride within the slot during the relative movement of the pawl bar with respect to the mounting bar. Normally, increases in ambient temperature in the vicinity of thermo-electric cylinders such as cylinder 400 will cause the extension of the cylinder rod 410 and thus will cause the device to acitvate in response to increases in preselected ambient temperatures. Alternatively, electric current may be supplied to the thermo-electric cylinder through wires 422 and 424 which will activate the cylinder to produce the same result. Upon return of the temperature surrounding the device to normal levels and/or upon the cessation of the receipt of activation signals through wires 422 or 424, the cylinder rod 410 will tend to retract into the body of the cylinder, thereby tending to bias latch block 300 into its locking position (the solid line position shown in FIG. 6). Once the pawl member is returned to the position shown in FIGS. 6 and 7, the latching block 300 will, of course, snap back into place thereby resetting the device and preparing it for its next activation.

While a thermo-electric cylinder is preferred for the embodiment of FIGS. 6 and 7, it is within the scope of the present invention to create an additional alternate embodiment by substituting therefore a solenoid or pneumatic cylinder for the cylinder shown in that embodiment. At the present time, such a substitution is not preferred since the cylinders do not naturally respond to increases in their surrounding ambient temperatures. In the event such cylinders are substituted, however, it is anticipated that instead of extending cylinder rod 410 into the position shown in phantom in FIG. 6, that the cylinder rod 410 could be adapted to be retractable so that the latching block 300 would be withdrawn from interference with the pawl bar 304 by reason of its extraction from rather than extension through the enlarged key slot portion of that bar.

Figure 8:
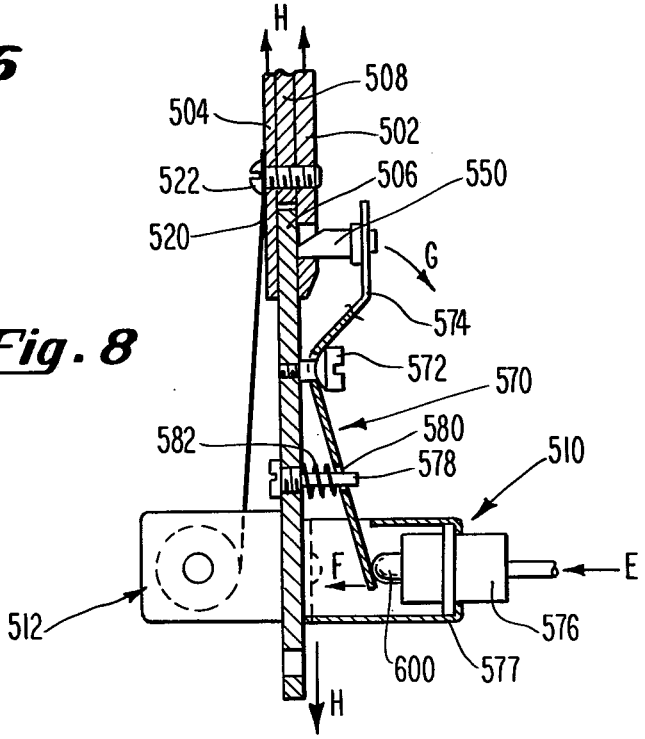
FIG. 8 is a fragmentary cross-section of a fourth alternate embodiment releasing device of the present invention shown in its normal position.

Referring now to FIG. 8, a fourth alternate embodiment heat responsive means is illustrated in combination with a force amplification device which enables relatively small forces generated by the heat responsive device in response to heat to nonetheless adequately activate the latching means of the present invention. FIG. 8 is similar to the embodiment of FIGS. 1–3 in that the pawl member is differentiated into spaced apart pawl bars 502 and 504 within which tracks mountin bar 506. As in the embodiments of FIGS. 4–7, a spacing member 508 is provided to establish the spacing between the spaced apart bars 502 and 504, to establish the path of travel between the pawl and mounting bars with respect to each other, and to limit the length of travel of those bars to define the normal and acitvated positions of those bars with respect to each other. As with the embodiment of FIGS. 1–3, the heat responsive means, designated generally 510 and the biasing means designated generally 512 are mounted on generally opposing sides of the mounting bar 506 at the remote end thereof. The tip 520 of the negator spring, designated generally 512 is again attached via a machine screw 522 (or rivet) against the external surface of pawl bar 504. Similarly, the laching means comprises a bevelled pin 550 which is adapted to coact with a latching aperture 552 defined in the proximate end of pawl bar 502 to restrain pawl bar movement with respect to mounting bar 506. Unlike the embodiments heretofore described, however, a force amplification means designated generally 570 is provided which comprises a fulcrum pin 572 around which is pivoted lever 574 having latching pin 550 mounted at one end and engaging heat responsive cylinder 576 at the other. The heat responsive cylinder 576 is mounted to a surface of mounting bar 506 by mounting housing 577 which spaces the thermo-electric cylinder 576 away therefrom while providing a clearance aperture defined therein for free movement of the lever 574 therewithin. In this embodiment, the biasing of the latching means into the normal position wherein the tip of the pin 550 engages a surface of the mounting bar 506 (which was provided in the above described embodiments by the action of the bimetallic element) is now provided by means of a guide posts 578 which rides within a slightly oversized aperture 580 defined in the lever, which guide posts 578 has disposed therearound a coil spring 582 which tends to separate the "handle" portion of the lever from the opposing surface of the mounting bar 506 to thereby bias the pin 550 into latching aperture 552. In response to a preselected increase in ambient temperature in the vicinity of thermo-electric cylinder 576, or alternatively, upon the receipt of an activating signal as schematically represented by arrow E in FIG. 8, the cylinder rod 600 of cylinder 576 will be caused to extend in the direction of arrow F to thereby pivot the lever around fulcrum pin 572 to cause bevelled pin 550 to withdraw generally in the direction of arrow G shown in FIG. 8, to thereby release and allow the sliding engagement of pawl members 502 and 504 with respect to mounting bar 506. Assuming that the expansive tension applied to the device is sufficient to overcome the contractive tension exerted by negator spring 512, the pawl bars 502 and 504 will slide relative to the mounting bar 506 to create movement of these various parts in the direction of arrow H in FIG. 8. Upon a slackening of the expansive tension applied by the device, and a return to normal temperature or signal conditions, the negator spring will cause the pawl bars and mounting bar to reassume the position shown in FIG. 8, whereupon movement of these members with respect to each other will be restrained by the insertion of pin 550 in latching aperture 552.

As shown from the above description, the various embodiments described may be simply and inexpensively constructed, while nonetheless providing automatically resetting releasing devices which are particularly well suited for insertion as links in cables which are used to deploy associated fire protection apparatus.

It will be understood that various changes in the details, materials and arrangement of parts which have been herein described and illustrated in order to explain the nature of this invention may be made by those skilled in the art within the principle and scope of the invention as expressed in the following claims. It will further be understood that the "Abstract of the Disclosure" set forth above is intended to provide a non-legal technical statement of the contents of the disclosure in compliance with the Rules of Practice of the United States Patent and Trademark Office, and is not intended to limit the scope of the invention described and claimed herein.

What is claimed is:

1. A heat responsive releasing device comprising:

(a) a mounting member;

(b) a pawl member slidingly engaging said mounting member for sliding movement between at least two positions defined therealong;

(c) latching means associated with said mounting member for selectively restraining said pawl member relative to said mounting member in at least one of said positions;

(d) heat responsive means associated with said latching means for causing said latching means to restrain said pawl member in response to a preselected normal ambient temperature and for causing said latching means to release said pawl member in response to at least a preselected increase in said ambient temperature; and (e) biasing means connected between said pawl member and said mounting member for generally biasing said pawl member and said mounting member into said at least one of said position.

2. The invention of claim 1 wherein said heat responsive means comprises a thermo-electric cylinder.

3. The invention of claim 1 wherein said heat responsive means comprises a bimetallic element.

4. The invention of claim 1 wherein said pawl member tracks relatively along said mounting member between said at least two portions, which positions are at least restrained and activated positions defined along said mounting member.

5. The invention of claim 4 wherein at least one of said mounting member and said pawl member further has said fixedly connected thereto an additional substantially parallel, spaced apart member for defining a channel therebetween for slidingly receiving the other of said members.

6. The invention of claim 5 wherein said apparatus further comprises spacing means disposed between said members for at least establishing the distance between said spaced apart members.

7. The invention of claim 6 wherein said other of said members further has an aperture defined therein, and wherein said spacing means is disposed substantially within said aperture.

8. The invention of claim 7 wherein said device further comprises stop means for preventing sliding movement of said members relatively beyond at least one of said positions.

9. The invention of claim 8 wherein said stop means further comprises a portion of said spacing means which is configured to interfere with a portion of said aperture upon movement of said members relatively into said at least one of said positions.

10. The invention of claim 9 wherein said stop means further comprises portions of said spacing means configured to engage and interfere with generally opposing portions of said aperture to thereby limit the relative sliding movement of said members beyond said restrained and activated positions.

11. The invention of claim 10 wherein said device further comprises tracking means, said tracking means comprising portions of said spacing means disposed to slidingly engage at least an edge of said aperture during the movement of said members relatively between said restrained and activated positions to guide said members during said movement between said positions.

12. The invention of claim 11 wherein said aperture comprises a slot defined in one of said members.

13. The invention of claim 12 wherein said spacing means, tracking means, and stop means comprise surfaces of an elongate spacing member disposed between said pawl and mounting members, the longitudinal surfaces of which are configured to slidingly engage interior surfaces of said slot defined in said other of said members, and the end surfaces of which are configured to engage interior surfaces of the ends of said slot to interfere with the movement of said pawl and mounting members relative to each other to thereby define said restrained and activated positions.

14. The invention of claim 12 wherein said spacing means, track means, and stop means comprise a plurality of spacing members disposed within said aperture.

15. The invention of claim 14 wherein said spacing members further comprise bushings disposed within said aperture, generally opposing surfaces of each of said bushings being sized to slidingly engage interior longitudinal surfaces of said slot.

16. The invention of claim 15 wherein portions of two of said bushings are disposed generally within said slot to engage interior surfaces of the ends of said slot upon movement of said members between said restrained and activated positions, said engagement creating an interference which prevents said members from being moved relatively beyond said restrained and activated positions.

17. The invention of claim 5 wherein said apparatus further comprises force amplification means connected between said latching means and said heat responsive means for amplifying the forces exerted by said heat responsive means upon said latching means.

18. The invention of claim 17 wherein said force amplification means further comprises a lever.

19. The invention of claim 17 wherein said latching means further comprises a pin associated with said mounting member and an aperture defined in said pawl member for receiving said pin.

20. The invention of claim 20 wherein said lever is pivotally mounted to said mounting member and has said pin mounted thereon.

21. The invention of claim 19 wherein said heat responsive means engages at least a portion of said lever to release said pawl member in response to said preselected increase in said ambient temperature by displacing at least a portion of said lever engaged thereby to draw said pin from said aperture.

22. The invention of claim 21 wherein said force amplification means further comprises spring means for biasing said lever generally towards said heat responsive means and for biasing said pin generally into said aperture.

23. The invention of claim 22 wherein said pin has a bevelled surface disposed thereon for, under normal ambient temperature conditions receiving and engaging at least a portion of said pawl member as said pawl and mounting members are moved into their restrained position, and for cooperating with at least a portion of said pawl member for overcoming said biasing of said spring means until said members have reached their restrained position, whereupon said pin is biased into said aperture.

24. The invention of claim 22 wherein said pawl means defines a surface which, under normal ambient temperature conditions, receives and engages a portion of said pin to displace said pin as said pawl member and mounting member are moved into said restrained position to thereby overcome the biasing of said spring means at least until said members move into said restrained position, whereupon said pin is biased into said aperture.

25. The invention of claim 17 wherein said force amplification means further comprises a guide means mounted on said mounting member and extending through an aperture in said lever for preventing the rotation of said lever about its fulcrum.

26. The invention of claim 1 wherein said latching means comprises at least one latching aperture defined in said pawl member, and at least one latching member associated with said mounting member, said latching member being biased by said heat responsive means into said aperture in response to said preselected normal ambient temperature.

27. The invention of claim 26 wherein said latching aperture is configured to receive said latching member when said pawl and mounting members are in their restrained positions, and to prevent the reception of said latching member when said members are moved toward said activted position.

28. The invention of claim 27 wherein said aperture is configured to receive at least a portion of said heat responsive means during the relative sliding of said pawl and mounting members toward said activated position.

29. The invention of claim 1 wherein said biasing means further comprises a negator-type spring.

30. The invention of claim 29 wherein said negator spring is connected between portions of said mounting member and said pawl member to exert forces on said members along an axis a path which is substantially parallel to the path of sliding engagement of said mounting and said pawl members.

* * * * *